US011318743B2

(12) United States Patent
Okubo et al.

(10) Patent No.: US 11,318,743 B2
(45) Date of Patent: May 3, 2022

(54) LIQUID EJECTING HEAD UNHAND LIQUID EJECTING APPARATUS

(71) Applicant: SEIKO EPSON CORPORATION, Tokyo (JP)

(72) Inventors: Katsuhiro Okubo, Azumino (JP); Shigeki Suzuki, Shiojiri (JP); Hiroyuki Hagiwara, Matsumoto (JP); Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/516,971

(22) Filed: Jul. 19, 2019

(65) Prior Publication Data

US 2019/0337293 A1 Nov. 7, 2019

Related U.S. Application Data

(63) Continuation of application No. 15/450,792, filed on Mar. 6, 2017, now Pat. No. 10,384,448.

(30) Foreign Application Priority Data

Apr. 12, 2016 (JP) ..... 2016-079816

(51) Int. Cl.
*B41J 2/14* (2006.01)
*B41J 2/045* (2006.01)

(52) U.S. Cl.
CPC ..... *B41J 2/14072* (2013.01); *B41J 2/04563* (2013.01); *B41J 2/1433* (2013.01); *B41J 2/14233* (2013.01); *B41J 2002/14362* (2013.01); *B41J 2002/14491* (2013.01); *B41J 2202/13* (2013.01); *B41J 2202/19* (2013.01); *B41J 2202/20* (2013.01)

(58) Field of Classification Search
CPC ..... B41J 2/155; B41J 2202/20; B41J 2202/19
See application file for complete search history.

(56) References Cited

U.S. PATENT DOCUMENTS 5,469,199 A 11/1995 Allen et al.
6,554,397 B1 * 4/2003 Williams ..... B41J 2/155 347/42
7,905,570 B2 3/2011 Ito
2003/0048330 A1 3/2003 Scheffelin
(Continued)

FOREIGN PATENT DOCUMENTS

JP 2007-001190 1/2007
JP 2007-268850 10/2007
(Continued)

*Primary Examiner* — Shelby L Fidler
(74) *Attorney, Agent, or Firm* — Workman Nydegger

(57) ABSTRACT

A liquid ejecting head unit includes an ejecting surface in which nozzles for ejecting a liquid are formed, and a first and a second circuit substrates for ejecting the liquid from the nozzles, in which a planar shape of the ejecting surface includes a first, a second and a third portions. A center line parallel to a long side of a rectangle of a minimum area surrounding the ejecting surface passes the first portion but not the second and third portions. The second and third portions are arranged adjacently to the first portion interposed therebetween. The first circuit substrate is positioned in the first and second portions. The second circuit substrate is positioned in at least one of the first and third portions.

13 Claims, 13 Drawing Sheets

(56) References Cited

U.S. PATENT DOCUMENTS

| | | | | |
|---|---|---|---|---|
| 2007/0008375 | A1 | 1/2007 | Tanikawa et al. | |
| 2007/0070103 | A1 | 3/2007 | Akune | |
| 2007/0242109 | A1 | 10/2007 | Ito | |
| 2007/0285448 | A1 | 12/2007 | Nakamura | |
| 2009/0002412 | A1 | 1/2009 | Kawakami | |
| 2009/0225130 | A1* | 9/2009 | Saito | B41J 2/155 347/40 |
| 2010/0053265 | A1 | 3/2010 | Kim | |
| 2010/0194823 | A1 | 8/2010 | Yamanaka | |
| 2012/0038709 | A1 | 2/2012 | Owaki | |
| 2013/0050315 | A1 | 2/2013 | Kusakari | |
| 2015/0239242 | A1 | 8/2015 | MacKenzie et al. | |
| 2015/0273826 | A1 | 10/2015 | Komatsu et al. | |
| 2015/0328883 | A1* | 11/2015 | Iijima | B41J 2/04541 347/9 |
| 2016/0136950 | A1 | 5/2016 | Kyohei | |
| 2016/0167382 | A1 | 6/2016 | Kyohei | |
| 2017/0144436 | A1 | 5/2017 | Brugue Garvi | |
| 2017/0165975 | A1* | 6/2017 | Lee | B41J 2/1752 |
| 2017/0182782 | A1* | 6/2017 | Lee | B41J 2/155 |
| 2019/0126618 | A1* | 5/2019 | Kitazawa | B41J 2/14201 |
| 2019/0126619 | A1* | 5/2019 | Kitazawa | B41J 2/01 |

FOREIGN PATENT DOCUMENTS

| | | |
|---|---|---|
| JP | 2010-149293 | 7/2010 |
| JP | 2012-040702 A | 3/2012 |
| JP | 2015-066844 | 4/2015 |
| JP | 2015-193158 A | 11/2015 |

* cited by examiner

LIQUID EJECTING HEAD UNHAND LIQUID EJECTING APPARATUS

CROSS-REFERENCE TO RELATED APPLICATIONS

The present application claims priority to Japanese Patent Application No. 2016-079816 filed Apr. 12, 2016, which is hereby incorporated by reference in its entirety.

BACKGROUND

1. Technical Field

The present invention relates to a liquid ejecting head unit and a liquid ejecting apparatus. In particular, the invention relates to an ink jet recording head unit which ejects an ink as a liquid, and an ink jet recording apparatus.

2. Related Art

An ink jet recording head unit which discharges an ink is a representative example of the liquid ejecting head unit. An ink jet recording head unit includes a plurality of ink jet recording heads which are drive units that discharge an ink, a holder which holds the ink jet recording heads, and a circuit substrate which is provided in the holder and causes the drive units to be driven (for example, refer to JP-A-2015-193158).

In the ink jet recording head unit, the circuit substrate is installed so as to stand on the top surface of the holder, and ink jet recording heads are provided on both sides of the circuit substrate. In other words, the circuit substrate is positioned in the center of the holder, and the ink jet recording heads are provided on both sides of the circuit substrate.

In the ink jet recording head unit according to JP-A-2015-193158, nozzle rows of the ink jet recording heads are arranged in a staggered pattern. Therefore, in order to arrange the nozzle rows in a staggered pattern across the plurality of ink jet recording heads, it is necessary to dispose the nozzle rows such that a portion of the nozzle rows overlap in a direction intersecting the one direction.

However, when a portion of the nozzle rows are overlapped between ink jet recording heads which are adjacent to each other, there is a problem in that the nozzle rows are not aligned in one direction. This is because the circuit substrate is provided in the center of the ink jet recording heads.

When the circuit substrate is provided in the center of the ink jet recording head, the width of an end portion in the one direction of the ink jet recording head (the width in a direction intersecting the one direction) is spread out. Therefore, when the ink jet recording heads are disposed so as to overlap a portion of the nozzle rows as described above, the nozzle rows of the ink jet recording heads may not be linearly disposed along one direction (refer to FIG. 12).

This problem is present not only in an ink jet recording head unit, but also in the same manner in a liquid ejecting head unit that ejects a liquid other than an ink.

SUMMARY

An advantage of some aspects of the invention is to provide a liquid ejecting head unit and a liquid ejecting apparatus capable of causing nozzles of a plurality of liquid ejecting head units to overlap and disposing the nozzles to be aligned linearly in one direction.

Aspect 1

According to an aspect of the invention, there is provided a liquid ejecting head unit which includes an ejecting surface in which a plurality of nozzles for ejecting a liquid are formed, and a first circuit substrate and a second circuit substrate for ejecting the liquid from the nozzles, in which a planar shape of the ejecting surface includes a first, a second and a third portions. The first portion is arranged across a center line which is parallel to a long side of a rectangle of a minimum area that surrounds the ejecting surface. The second portion is arranged away from the center line and arranged adjacently to the first portion along the long side. The third portion is arranged away from the center line and arranged adjacently to the first portion along the long side with the first portion interposed with the second portion. In which the first circuit substrate is positioned in the first portion and the second portion, and in which the second circuit substrate is positioned in at least one of the first portion and the third portion.

In this aspect, a liquid ejecting head unit is provided in which it is possible to cause the nozzles of a plurality of the liquid ejecting head units to overlap and to be disposed aligned linearly in one direction.

Aspect 2

In the liquid ejecting head unit, it is preferable that the second portion and the third portion is positioned on opposite sides interposing the center line. Accordingly, it is possible to utilize common parts in the first circuit substrate and the second circuit substrate.

Aspect 3

In the liquid ejecting head unit, it is preferable that the liquid ejecting head unit further includes a first drive unit, and a second drive unit, the first drive unit may be connected to the first circuit substrate and may be positioned in the first portion and the second portion, and the second drive unit may be connected to the second circuit substrate and may be positioned in at least one of the first portion and the third portion. Accordingly, it is easy to connect the first drive unit and the second drive unit to the first circuit substrate and the second circuit substrate, respectively.

Aspect 4

In the liquid ejecting head unit, it is preferable that the liquid ejecting head unit further includes a third drive unit, and a fourth drive unit, the third drive unit is connected to the first circuit substrate and is positioned in the first portion, and the fourth drive unit is connected to the second circuit substrate and is positioned in the first portion. Accordingly, it is easy to connect the third drive unit and the fourth drive unit to the first circuit substrate and the second circuit substrate, respectively.

Aspect 5

In the liquid ejecting head unit, it is preferable that a wiring which connects drive units which are connected to the first circuit substrate to the first circuit substrate, and the wiring which connects drive units which are connected to the second circuit substrate to the second circuit substrate are all the same. Accordingly, it is possible to reduce the occurrence of variation in the ejection characteristics between the first drive units which are connected to the first circuit substrate, and the drive units which are connected to the second circuit substrate.

Aspect 6

In the liquid ejecting head unit, it is preferable that the first and second drive units be connected to the first circuit substrate and the second circuit substrate, respectively, using wiring heading from the first and second drive units in a direction which is orthogonal to the ejecting surface. Accordingly, the nozzle rows of the first drive unit and the second drive unit may be easily caused to overlap each other.

Aspect 7

In the liquid ejecting head unit, it is preferable that the liquid ejecting head unit further include a fixing plate which fixes the first drive unit and the second drive unit, and a temperature sensor which abuts the fixing plate, and the temperature sensor be positioned in the first portion and be connected to at least one of the first circuit substrate and the second circuit substrate. Accordingly, it is possible to measure the temperature of the plurality of drive units using the temperature sensor of the first portion. The temperature sensor is held in the liquid ejecting head unit. Therefore, during the exchanging of the liquid ejecting head units and the like, even if the liquid leaks and reaches the ejecting surface, it is possible to suppress the adherence of the liquid to the temperature sensor.

Aspect 8

In the liquid ejecting head unit, it is preferable that the liquid ejecting head unit further include a third circuit substrate which includes a connector on an opposite side from the ejecting surface in a direction which is orthogonal to the ejecting surface and is connected to the first circuit substrate. Accordingly, since connector is provided on the opposite side from the ejecting surface, it is easy to reconnect the wiring to and from the connector.

Aspect 9

In the liquid ejecting head unit, it is preferable that the third circuit substrate be connected to the second circuit substrate, and the connector be positioned in the first portion. Accordingly, since it is not necessary to connect the first circuit substrate and the second circuit substrate individually to the external control device, it is possible to reduce the number of connectors for connecting to the outside. Since it is possible to reduce the number of connectors, it is easy to detach and attach the liquid ejecting head unit. It is easy to connect the first circuit substrate and the second circuit substrate to the connector using a wiring.

Aspect 10

In the liquid ejecting head unit, it is preferable that the liquid ejecting head unit further include a flow path member which is provided with a flow path which communicates with the nozzles, each of the first circuit substrate and the second circuit substrate include a substrate which is parallel to a plane including a direction which is orthogonal to the ejecting surface and a direction which is parallel to the long side of the rectangle, and the flow path member be positioned in the first portion to the third portion and may be positioned between the first circuit substrate and the second circuit substrate in a direction which is parallel to a short side of the rectangle. Accordingly, it is possible to reduce the size of the width of the liquid ejecting head unit in the short side direction.

Aspect 11

According to another aspect of the invention, there is provided a liquid ejecting apparatus including a plurality of the liquid ejecting head units according any one of aspects 1 to 10 in a direction which is parallel to the long side of the rectangle.

In this aspect, it is possible to realize a liquid ejecting apparatus in which a plurality of the liquid ejecting head units having the same configuration are used, the nozzles are caused to overlap and to be disposed aligned linearly in one direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Detailed description will be given of an embodiment of the invention. In the present embodiment, an ink jet recording head unit (hereinafter also simply referred to as a head unit) which discharges an ink will be described as an example of a liquid ejecting head unit. An ink jet recording apparatus which is provided with a head unit will be described as an example of a liquid ejecting apparatus.

Figure 1:
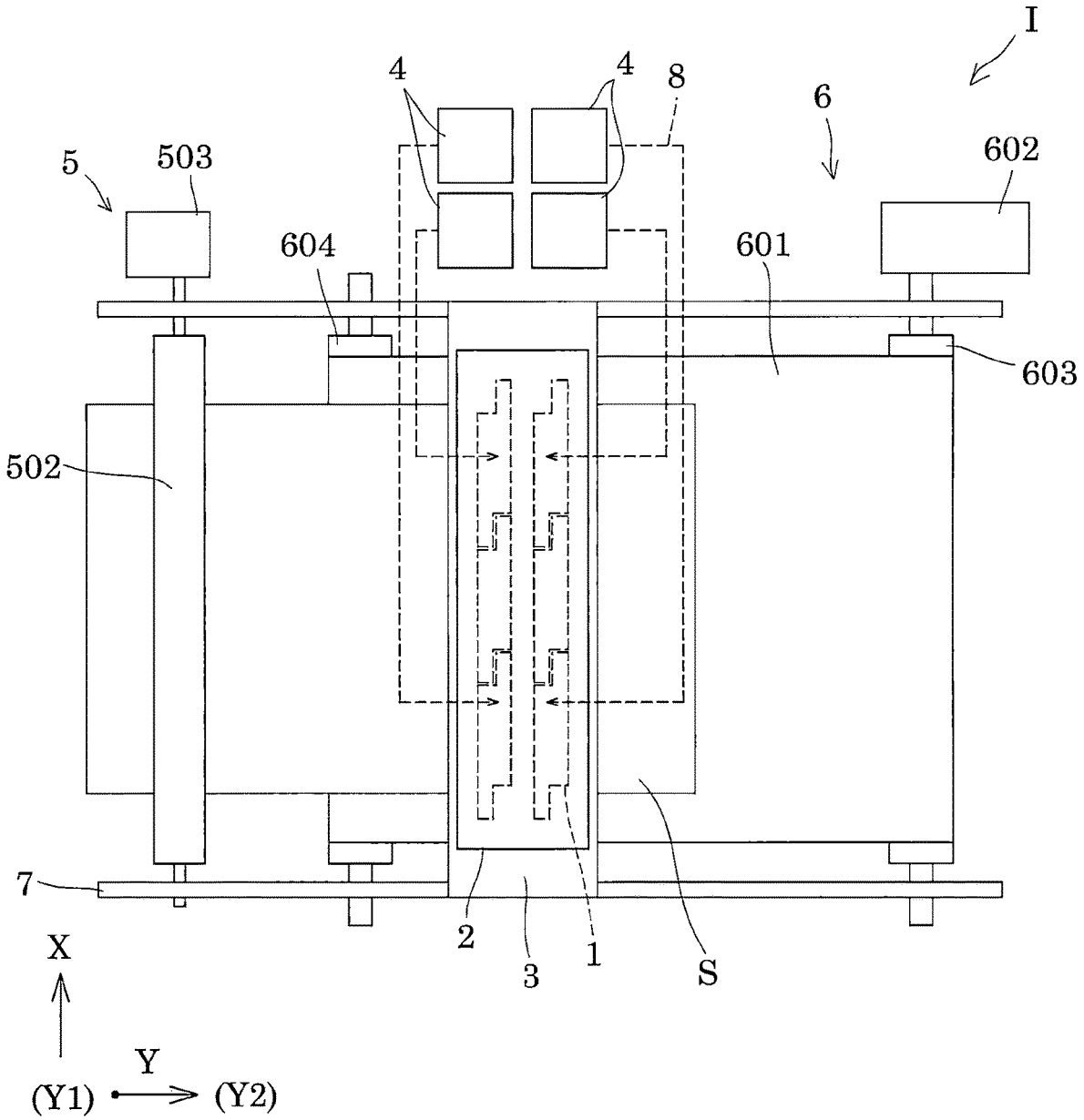
FIG. 1 is a top surface diagram illustrating the schematic configuration of an ink jet recording apparatus.
Figure 2:
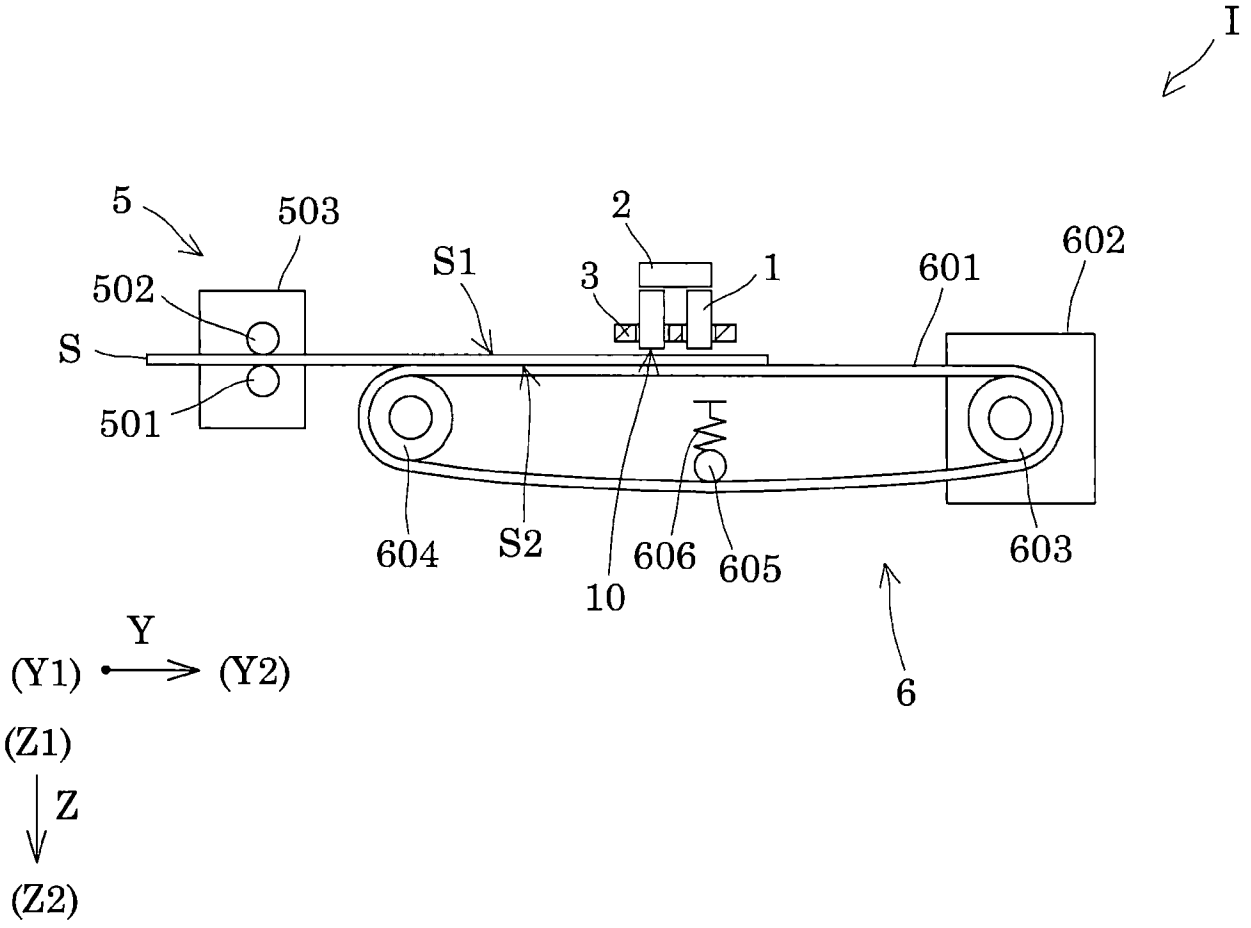
FIG. 2 is a side surface diagram illustrating the schematic configuration of the ink jet recording apparatus.

FIG. 1 is a top surface diagram illustrating the schematic configuration of an ink jet recording apparatus according to the present embodiment, and FIG. 2 is a side surface diagram illustrating the schematic configuration of the ink jet recording apparatus.

An ink jet recording apparatus I is a so-called line system ink jet recording apparatus which performs printing by simply transporting a recording sheet S which is an ejection-target medium.

The ink jet recording apparatus I includes a plurality of head units 1, a supply member 2 which supplies an ink to the plurality of head units 1, a supporting body 3 which supports the plurality of head units 1, a liquid storage unit 4 such as an ink tank which stores the ink, and an apparatus main body 7.

The plurality of head units 1 are held by the supporting body 3. Specifically, a plurality, three in the present embodiment, of the head units 1 are provided to line up in a direction intersecting the transport direction of the recording sheet S. Hereinafter, the direction in which the head units 1 are lined up will be referred to as a first direction X. In the supporting body 3, a plurality of rows in which the head units 1 are lined up in the first direction X are provided in the transport direction of the recording sheet S, and in the present embodiment, two rows are provided. The direction in which the plurality of rows of the head units 1 are provided to line up is also referred to as a second direction Y, an upstream side in the transport direction of the recording sheet S in the second direction Y is referred to as a Y1 side, and the downstream side is referred to as a Y2 side. A direction intersecting both the first direction X and the second direction Y is referred to as a third direction Z in the present embodiment, a head unit 1 side is referred to as a Z1 side, and a recording sheet S side is referred to as a Z2 side. In the present embodiment, the relationship between the directions (X, Y, and Z) is orthogonal; however, the dispositional relationship of the components is not necessarily limited to being orthogonal. The supporting body 3 which holds the head unit 1 is fixed to the apparatus main body 7. The supply member 2 is fixed to the plurality of head units 1 which are held by the supporting body 3. The ink which is supplied from the supply member 2 is supplied to the head units 1.

The liquid storage unit 4 is formed of a tank or the like in which the ink is stored as a liquid, and in the present embodiment, the liquid storage unit 4 is fixed to the apparatus main body 7. The ink from the liquid storage unit 4 which is fixed to the apparatus main body 7 is supplied to the supply member 2 via a supply pipe 8 such as a tube, and the ink which is supplied to the supply member 2 is supplied to the head unit 1. The liquid storage unit 4 such as an ink cartridge may be mounted on the Z1 side in the third direction Z of the supply member 2, for example, in an aspect in which the supply member 2 of the head unit 1 includes the liquid storage unit 4.

The ink jet recording apparatus I may include a transport unit. A first transport unit 5 which serves as an example of the transport unit is provided on the Y1 side in the second direction Y. The first transport unit 5 includes a first transport roller 501, and a first following roller 502 which follows the first transport roller 501. The first transport roller 501 is provided on the side of a back surface S2 of the opposite side to a landing surface S1 of the recording sheet S on which the ink lands, and is driven by the driving force of a first drive motor 503. The first following roller 502 is provided on the landing surface S1 side of the recording sheet S, and sandwiches the recording sheet S with the first transport roller 501. The first following roller 502 presses the recording sheet S toward the first transport roller 501 side using a biasing member such as a spring (not illustrated).

A second transport unit 6 which serves as an example of the transport unit is provided on the Y2 side which is the downstream side of the first transport unit 5, and includes a transport belt 601, a second drive motor 602, a second transport roller 603, a second following roller 604, and a tension roller 605.

The second transport roller 603 is driven by the driving force of the second drive motor 602. The transport belt 601 is formed of an endless belt, and is wrapped around the outer circumference of the second transport roller 603 and the second following roller 604. The transport belt 601 is provided on the back surface S2 of the recording sheet S. The tension roller 605 is provided between the second transport roller 603 and the second following roller 604, abuts the inner circumferential surface of the transport belt 601, and applies tension to the transport belt 601 through the biasing force of a biasing member 606 such as a spring. Accordingly, the transport belt 601 has a flat surface that mutually faces the head unit 1 between the second transport roller 603 and the second following roller 604.

In the ink jet recording apparatus I, while transporting the recording sheet S from the Y1 side to the Y2 side in the second direction Y with respect to the head unit 1 using the first transport unit 5 and the second transport unit 6, ink is ejected from the head unit 1, and the ejected ink is caused to land on the landing surface S1 of the recording sheet S to perform the printing. The transport unit is not limited to the first transport unit 5 and the second transport unit 6 which are described above, and a transport unit using a so-called drum, a transport unit including a platen, or the like may be used.

Figure 3:
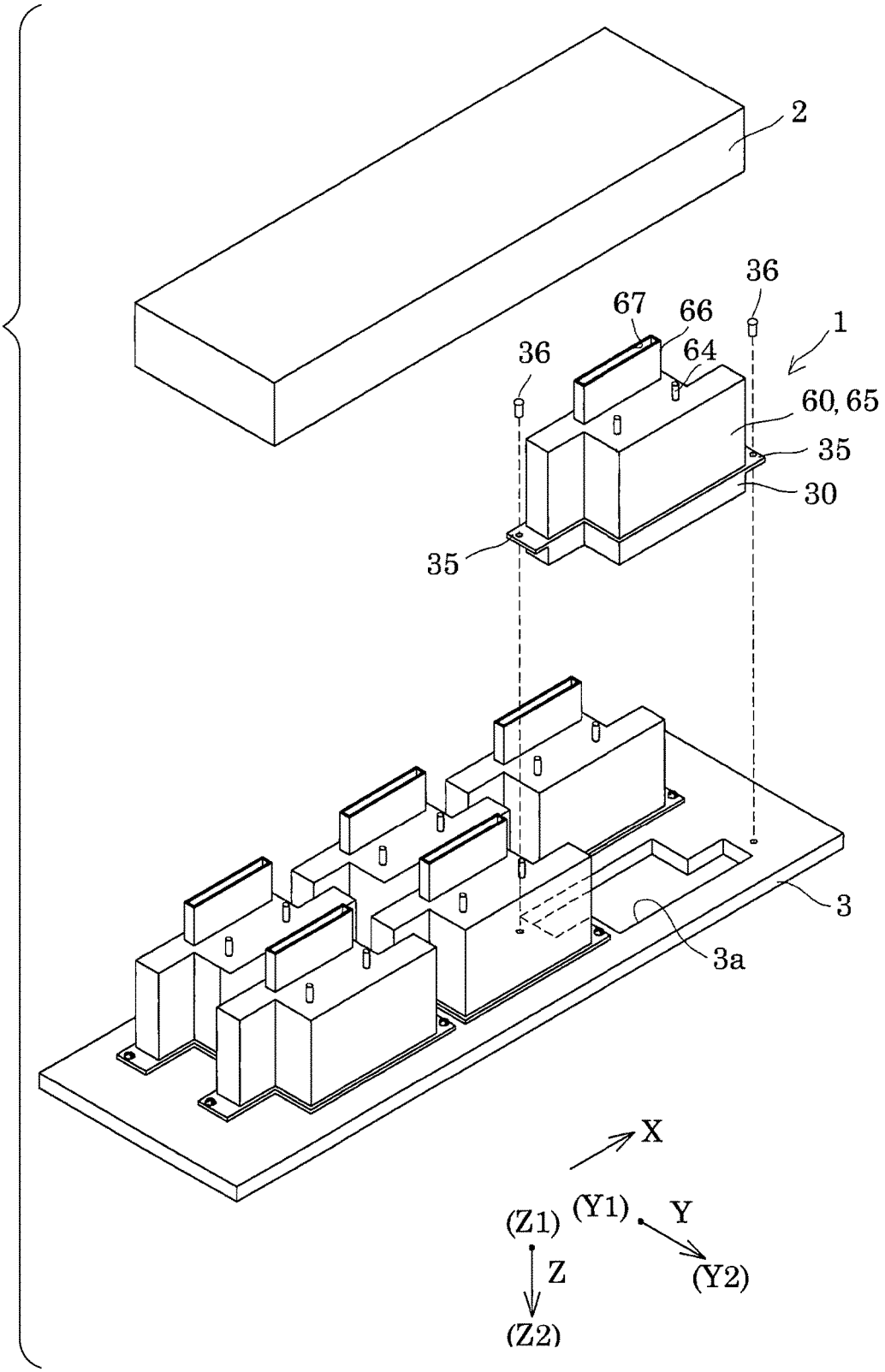
FIG. 3 is an exploded perspective diagram of a head unit and a supporting body.
Figure 4:
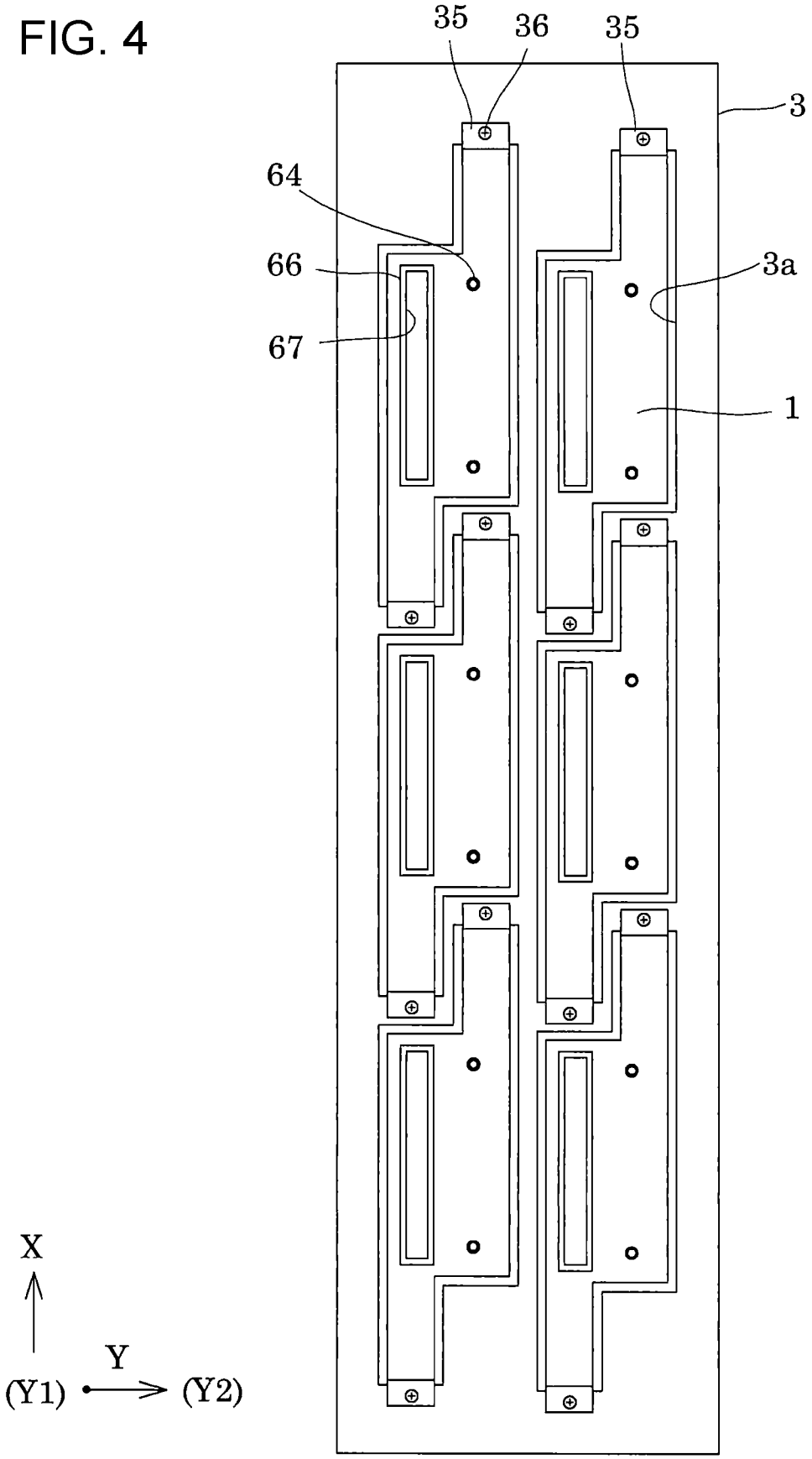
FIG. 4 is a top surface diagram of the head unit and the supporting body.
Figure 5:
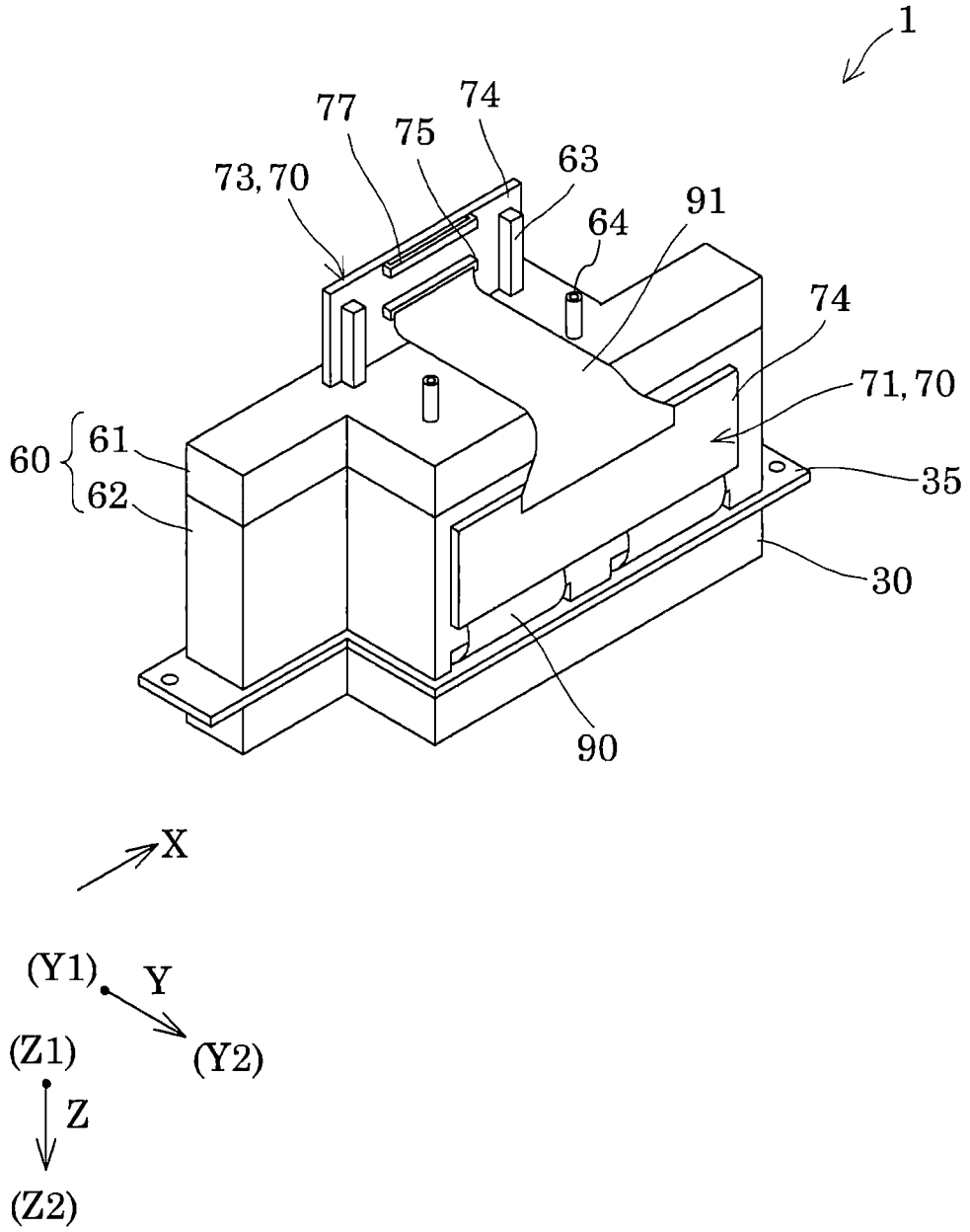
FIG. 5 is a perspective diagram of the head unit.
Figure 6:
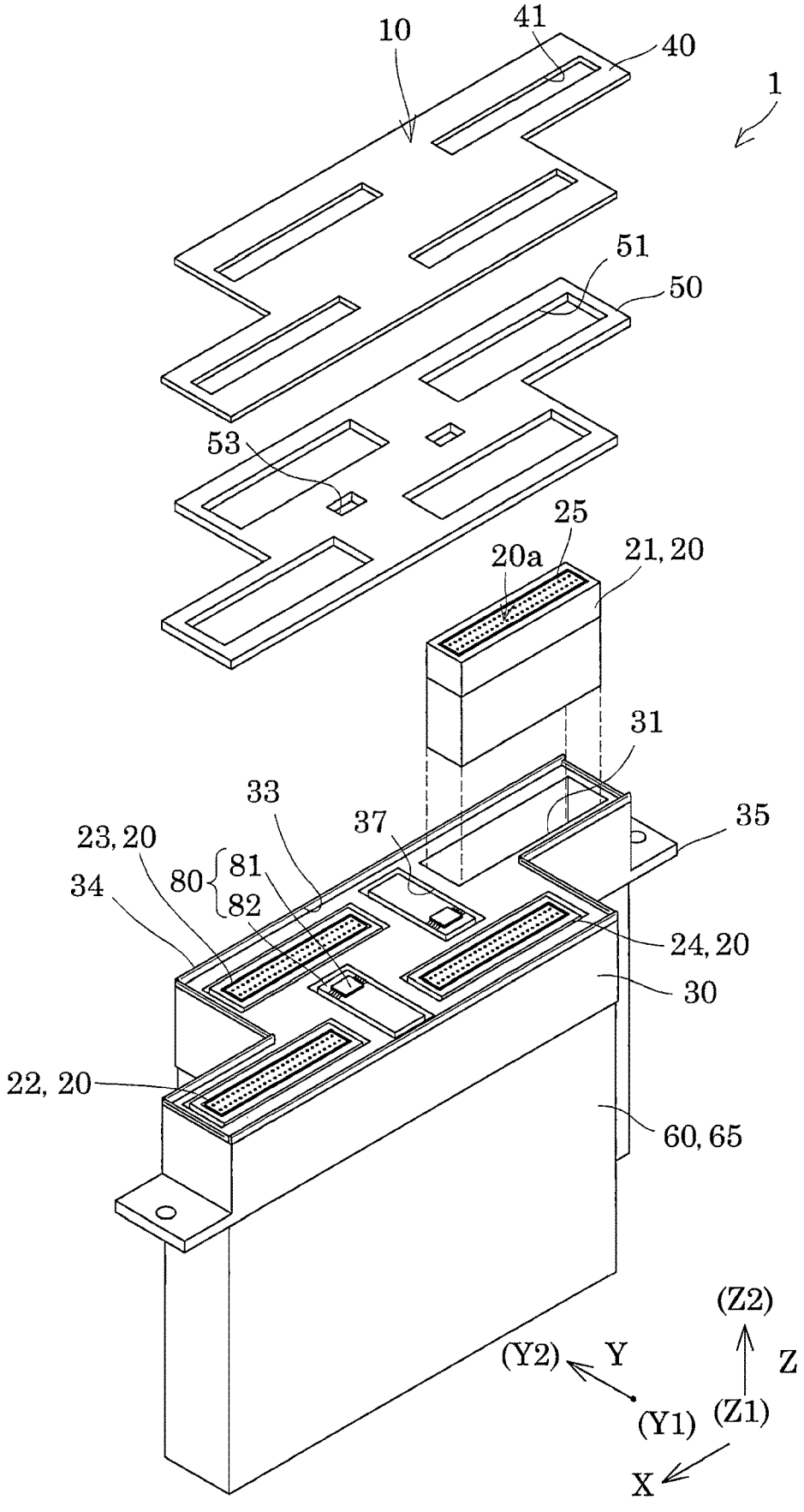
FIG. 6 is an exploded perspective diagram of the head unit.
Figure 7:
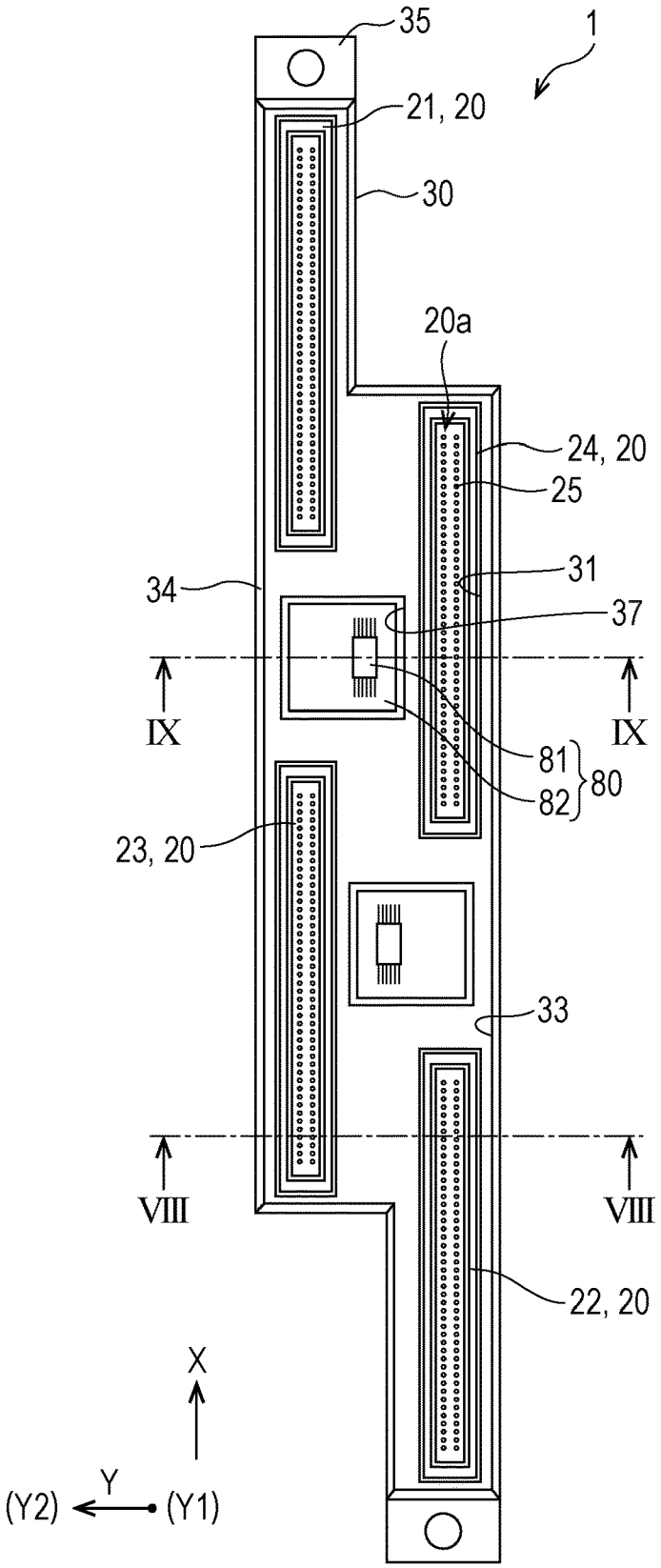
FIG. 7 is a plan view of the main components of the head unit.
Figure 8:
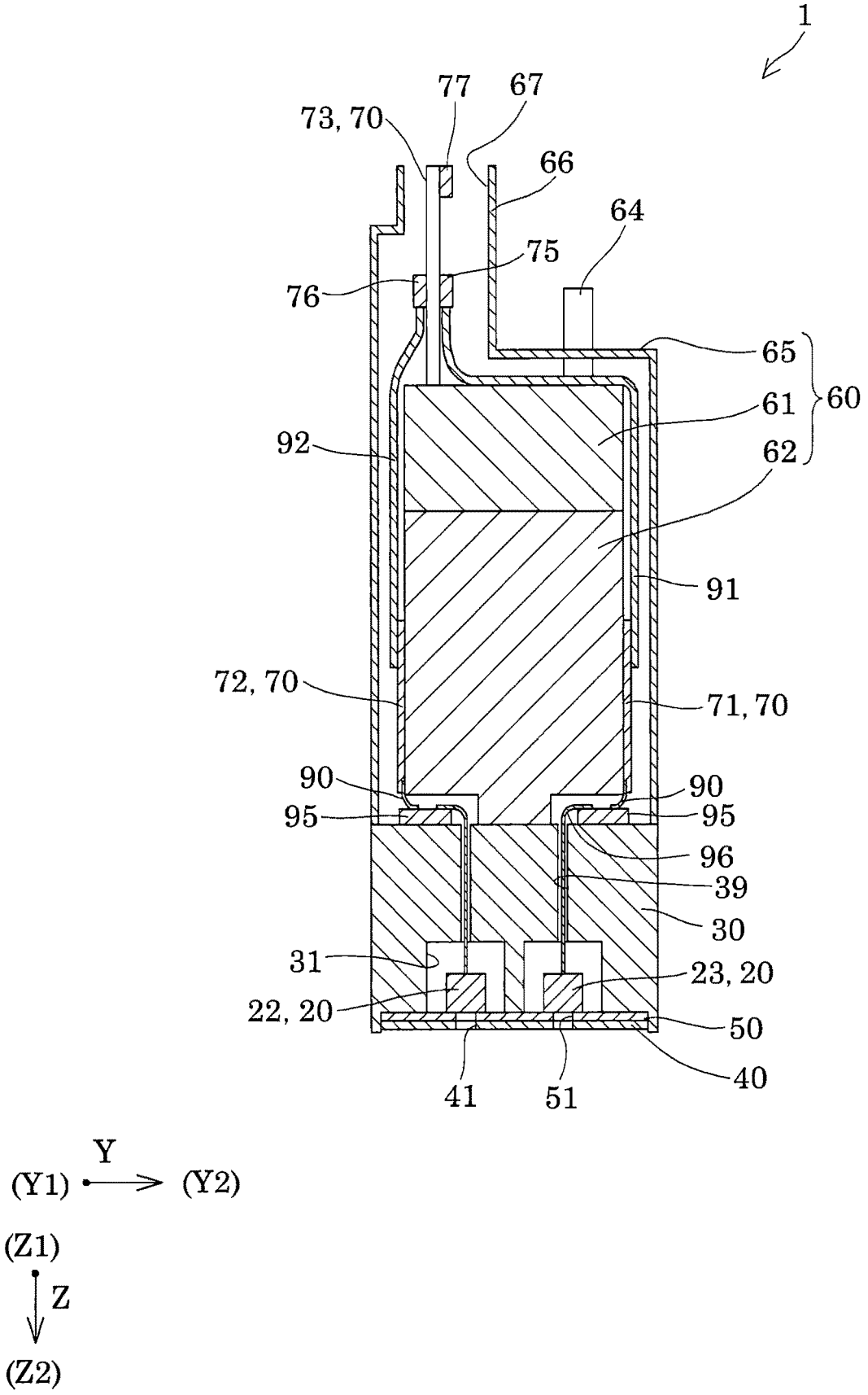
FIG. 8 is a sectional diagram taken along the line VIII-VIII of FIG. 7.
Figure 9:
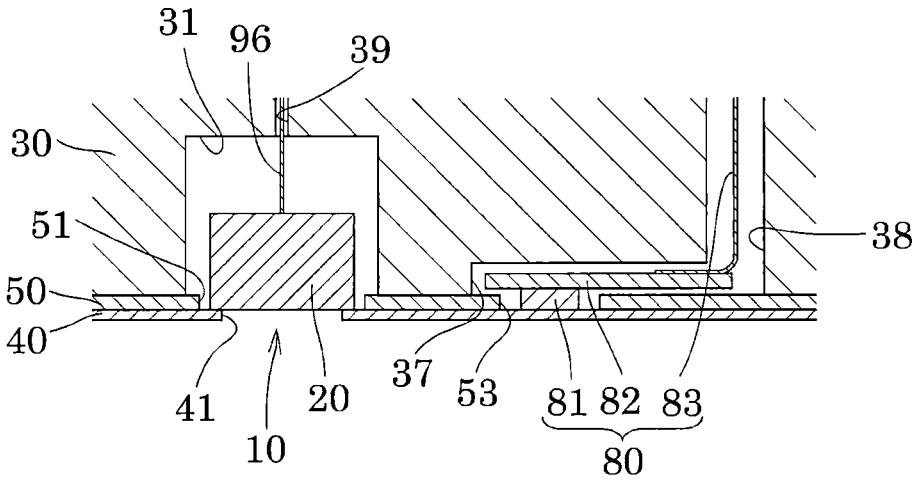
FIG. 9 is a sectional diagram taken along the line IX-IX of FIG. 7.
Figure 9:
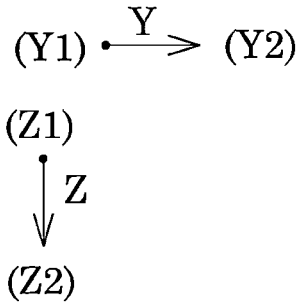

Detailed description will be given of the head unit 1 with reference to FIGS. 3 to 8. FIG. 3 is an exploded perspective diagram of a head unit and a supporting body, FIG. 4 is a top surface diagram of the head unit and the supporting body, FIG. 5 is a perspective diagram of the head unit, FIG. 6 is an exploded perspective diagram of the head unit, FIG. 7 is a plan view of the main components of the head unit, FIG. 8 is a sectional diagram taken along the line VIII-VIII of FIG. 7, and FIG. 9 is a sectional diagram taken along the line IX-IX of FIG. 7. For the head unit 1 of FIG. 5, a cover member 65 is omitted, and the inner portion of the cover member 65 is illustrated.

As illustrated in FIGS. 3 and 4, the supporting body 3 which supports the plurality of head units 1 is formed of a plate member which is formed of a conductive material such as a metal. A support hole 3*a* for holding each of the head units 1 is provided in the supporting body 3. In the present embodiment, the support holes 3*a* are provided independently for each of the head units 1. Naturally, the support holes 3*a* may be provided continuously across the plurality of head units 1.

The head unit 1 is held inside the support hole 3*a* of the supporting body 3 in a state in which an ejecting surface 10 is caused to protrude from the surface of the Z2 side of the supporting body 3. The ejecting surface 10 of the present embodiment is a surface which faces the recording sheet S of the head unit 1, and is a surface of the Z2 side of a fixing plate 40, which will be described later.

The head unit 1 is provided with a holder 30 which holds the drive units which are described later. Flange portions 35 are provided on both sides of the holder 30 in the first direction X to be integral with the holder 30. The flange portions 35 are fixed to the supporting body 3 by fixing screws 36. A plurality of the head units 1 which are held by the supporting body 3 in this manner are provided in the first direction X. In the present embodiment three rows of the head units 1 which are provided to line up are provided in two rows in the second direction Y.

As illustrated in FIGS. 5 and 6, the head unit 1 is provided with an ejecting surface 10 in which a plurality of nozzles 25 which eject ink are formed, a first circuit substrate 71, a second circuit substrate 72 (refer to FIG. 8), and a third circuit substrate 73 which are for ejecting the ink from the nozzles 25. The head unit 1 includes a first drive unit 21, a second drive unit 22, a third drive unit 23, and a fourth drive unit 24 which include the nozzles 25 and cause the ink to be ejected from the nozzles 25, the holder 30, the fixing plate 40, a reinforcing plate 50, and a flow path member 60.

The first drive unit 21, the second drive unit 22, the third drive unit 23, and the fourth drive unit 24 are collectively referred to as a drive unit 20. The first circuit substrate 71, the second circuit substrate 72, and the third circuit substrate 73 are collectively referred to as a circuit substrate 70.

As illustrated in FIG. 7, the nozzles 25 which eject the ink are provided to line up along the first direction X in the drive unit 20. In the drive unit 20, a plurality of rows in which the nozzles 25 are lined up in the first direction X are provided in the second direction Y, and in the present embodiment, two rows are provided.

The drive unit 20 is provided with a flow path which communicates with the nozzles 25 (not illustrated), and a pressure generating unit which generates a pressure change in the ink in the flow path. As the pressure generating unit, for example, it is possible to use a pressure generating unit which causes the volume of the flow path to change through the deformation of a piezoelectric actuator including a piezoelectric material which exhibits an electromechanical conversion function, generates a pressure change in the ink inside the flow path, and discharges ink droplets from the nozzles 25. It is also possible to use a pressure generating unit in which a heat generating element is disposed inside the flow path, and ink droplets are discharged from the nozzles 25 due to bubbles which are generated by the heat generation of the heat generating element. It is also possible to use a so-called electrostatic actuator or the like which generates an electrostatic force between a diaphragm and an electrode, causes the diaphragm to deform using the electrostatic force, and discharges ink droplets from the nozzles 25. The surface in which the nozzles 25 of the drive unit 20 are opened is a nozzle surface 20*a*. In other words, the nozzle surface 20*a* in which the nozzles 25 are formed is included in the ejecting surface 10 of the head unit 1.

As illustrated in FIGS. 5 to 8, the holder 30 is formed of a conductive material such as a metal, for example. The holder 30 has a greater strength than the fixing plate 40. Housing portions 31 which house the plurality of drive units 20 are provided on the surface of the Z2 side of the holder 30 in the third direction Z. The housing portions 31 have a concave shape which is opened to one side in the third direction Z, and house the plurality of drive units 20 which are fixed by the fixing plate 40. The openings of the housing portions 31 are sealed by the fixing plate 40. In other words, the drive units 20 are housed in the inner portion of the space which is formed by the housing portions 31 and the fixing plate 40. The housing portions 31 may be provided for each of the drive units 20, and may be provided continuously across the plurality of drive units 20. In the present embodiment, the housing portions 31 are provided independently for each of the drive units 20.

The drive units 20 are disposed in a staggered pattern along the first direction X in the holder 30. Disposing the drive units 20 staggered along the first direction X means disposing the drive units 20 which are provided to line up in the first direction X alternately shifted in the second direction Y. In other words, two rows of the drive units 20 which are provided to line up in the first direction X are provided to line up in the second direction Y, and the two rows of the drive units 20 are disposed shifted by a half pitch in the first direction X. By disposing the drive units 20 staggered along the first direction X in this manner, it is possible to cause the nozzles 25 of the two drive units 20 to partially overlap in the first direction X to form rows of the nozzles 25 which are continuous across the first direction X.

As illustrated in FIGS. 6 to 8, a recessed portion 33 which has a recessed shape to which the reinforcing plate 50 and the fixing plate 40 are fixed is provided on the surface of the Z2 side of the holder 30 at which the housing portion 31 is provided. In other words, the outer circumferential edge portion of the surface of the Z2 side of the holder 30 is an edge portion 34 which is provided to protrude to the Z2 side, and the recessed portion 33 is formed by the edge portion 34 which protrudes to the Z2 side. The reinforcing plate 50 and the fixing plate 40 are sequentially stacked on the bottom surface of the recessed portion 33. In the present embodiment, the bottom surface of the recessed portion 33 of the holder 30 is adhered to the reinforcing plate 50 using an adhesive, and the reinforcing plate 50 is adhered to the fixing plate 40 using an adhesive.

The fixing plate 40 is formed of a plate member which is formed of a conductive material such as a metal. The fixing plate 40 is provided with exposure opening portions 41 which expose the nozzle surfaces 20*a* of the drive units 20. In the present embodiment, the exposure opening portions 41 are provided independently for each of the drive units 20. The fixing plate 40 is fixed to the nozzle surface 20*a* side of the drive units 20 at the circumferential edge portion of the exposure opening portions 41.

The fixing plate 40 is fixed to the inside of the recessed portion 33 of the holder 30 via the reinforcing plate 50 so as to block the opening of the housing portion 31 of the holder 30.

It is preferable to use a material with a greater strength than the fixing plate 40 for the reinforcing plate 50. In the present embodiment, a plate member of the same material as the fixing plate 40 and which is thicker than the fixing plate 40 in the third direction Z is used for the reinforcing plate 50.

Opening portions 51 which have inner diameters larger than the outer circumferences of the drive units 20 are provided to penetrate the reinforcing plate 50 in the third direction Z in correspondence with the drive units 20 which are bonded to the fixing plate 40. The drive units 20 which are inserted into the opening portions 51 of the reinforcing plate 50 are bonded to the surface on the Z1 side of the fixing plate 40.

The fixing plate 40 and the holder 30 are pressed against each other at a predetermined pressure in a state in which the surface of the Z2 side of the fixing plate 40 is supported by a supporting tool (not illustrated), and are bonded together. Incidentally, in the present embodiment, in the fixing plate 40, a bonded body in which the drive units 20, the reinforcing plate 50, and the fixing plate 40 are bonded in advance is fixed to the holder 30.

The flow path member 60 is fixed to the Z1 side of the holder 30. In the present embodiment, the flow path member 60 is provided with a first flow path member 61, a second flow path member 62, and the cover member 65. The first flow path member 61 is provided on the Z1 side of the second flow path member 62, and the second flow path member 62 is supported on the Z1 side of the holder 30. The cover member 65 has a concave shape which houses the first flow path member 61 and the second flow path member 62, and the circuit substrate 70 therein, and is fixed to the holder 30 in a state of housing the first flow path member 61 and the second flow path member 62, and the circuit substrate 70 therein.

Flow paths for supplying the ink to the drive units 20 are provided in the inner portions (not illustrated) of the first flow path member 61 and the second flow path member 62. Supply units 64 which communicate with the flow paths are provided on the Z1 side of the first flow path member 61. In the supply units 64, the ink is supplied from the supply member 2. In the present embodiment, two of the supply units 64 are provided along the first direction X.

Although not specifically illustrated, in the inner portion of the first flow path member 61, the flow path which communicates with one of the supply units 64 is split and distributes the ink to the first drive unit 21 and the third drive unit 23. Similarly, the flow path which communicates with the other of the supply units 64 is split and distributes the ink to the second drive unit 22 and the fourth drive unit 24.

Although not specifically illustrated, the second flow path member 62 is provided with a flow path which supplies the ink which is supplied from the first flow path member 61 to the drive unit 20. In the flow path which is provided on the inner portion of the second flow path member 62, there are provided a filter which removes foreign matter such as dust and bubbles which are contained in the ink, a pressure regulating valve which opens and closes in accordance with the pressure of the flow path of the downstream side, and the like. The flow path member 60 is not limited to the first flow path member 61 and the second flow path member 62.

As illustrated in FIGS. 5 and 8, the first circuit substrate 71 is provided with a substrate 74, a terminal portion (not illustrated) which is connected to a relay wiring 90, and a terminal portion (not illustrated) which is connected to a first connection wiring 91. Similarly, the second circuit substrate 72 is provided with the substrate 74, the terminal portion (not illustrated) which is connected to the relay wiring 90, and the terminal portion (not illustrated) which is connected to a second connection wiring 92. The third circuit substrate 73 is provided with the substrate 74, a first connector 75 to which the first connection wiring 91 is connected, a second connector 76 to which the second connection wiring 92 is connected, and a third connector 77. The circuit substrates 70 are provided with electronic components, wirings, and the like which are not specifically illustrated in addition to the terminal portions and connectors which are described above.

The third circuit substrate 73 is provided to stand on the Z1 side of the first flow path member 61 such that both surfaces of the substrate 74 face the Y1 and Y2 sides in the second direction Y, respectively. In the present embodiment, the third circuit substrate 73 is fixed to a support portion 63 which is provided to stand on the Z1 side of the second flow path member 62.

The first connection wiring 91 is connected to the first connector 75 which is provided on the third circuit substrate 73. The first connection wiring 91 is a wiring which connects the first connector 75 to the terminal portion (not illustrated) of the first circuit substrate 71. The second connection wiring 92 is connected to the second connector 76 which is provided on the third circuit substrate 73. The second connection wiring 92 is a wiring which connects the second connector 76 to the terminal portion (not illustrated) of the second circuit substrate 72.

The cover member 65 is provided with a substrate housing portion 66 which houses the third circuit substrate 73 and the third connector 77 is exposed from a connection opening portion 67 which is provided on the Z1 side of the substrate housing portion 66. Wiring (not illustrated) for connecting to an external control unit is connected to the third connector 77. A print signal and power from the external control unit are supplied to the third circuit substrate 73 via the wiring.

The first circuit substrate 71 is provided on a side surface of the second flow path member 62 facing the Y2 side. The first circuit substrate 71 is connected to the third circuit substrate 73 via the first connection wiring 91, and is connected to the first drive unit 21 and the third drive unit 23 (refer to FIGS. 6 and 7) via the relay wiring 90, a relay substrate 95, and a wiring substrate 96.

The second circuit substrate 72 is provided on a side surface of the second flow path member 62 facing the Y1 side. The second circuit substrate 72 is connected to the third circuit substrate 73 via the second connection wiring 92, and is connected to the second drive unit 22 and the fourth drive unit 24 (refer to FIGS. 6 and 7) via the relay wiring 90, the relay substrate 95, and the wiring substrate 96.

The relay substrate 95 is provided on the surface of the Z1 side of the holder 30. The holder 30 is provided with a communication hole 39 which penetrates in the Z direction and causes the housing portion 31 to communicate with the Z1 side. The wiring substrate 96 which is connected to the drive unit 20 is inserted through the communication hole 39. One end of the wiring substrate 96 is connected to the drive unit 20, and the other end is connected to the relay substrate 95. For the relay wiring 90 and the wiring substrate 96, it is possible to use a flexible sheet, for example, a COF substrate or the like. In addition, an FFC, an FPC, or the like may be used for the relay wiring 90 and the wiring substrate 96.

The wiring substrate 96 is a substrate on which a wiring for supplying a signal and power for driving the drive unit 20 is installed. The wiring substrate 96 is connected to the first circuit substrate 71 or the second circuit substrate 72 via the relay substrate 95 and the relay wiring 90.

By configuring the circuit substrate 70 in this manner, a print signal and power are supplied from the external control unit to the third circuit substrate 73 from the third connector 77. The print signal and the like are supplied to the first drive unit 21 and the third drive unit 23 via the first connection wiring 91, the first circuit substrate 71, the relay substrate 95, and the wiring substrate 96. The print signal and the like are supplied to the second drive unit 22 and the fourth drive unit 24 via the second connection wiring 92, the second circuit substrate 72, the relay substrate 95, and the wiring substrate 96.

In the head unit 1 which is configured as described above, the ink is supplied from the supply member 2 via the flow path member 60, and the pressure generating unit inside the drive unit 20 is driven based on the print signal which is supplied via the circuit substrate 70 thereby ejecting ink droplets from the nozzles 25.

As illustrated in FIGS. 6 and 9, the head unit 1 according to the present embodiment is provided with a temperature sensor 81. Specifically, a sensor housing portion 37 and a through hole 38 are provided in the holder 30 of the present embodiment, and a temperature sensor module 80 is provided in the sensor housing portion 37.

The temperature sensor module 80 is provided with the temperature sensor 81, a substrate 82, and a sensor wiring 83. The sensor housing portion 37 has a recessed shape which is opened on the Z2 side on the bottom surface of the recessed portion 33 of the holder 30. The temperature sensor module 80 in which the temperature sensor 81 is installed on the substrate 82 is housed in the sensor housing portion 37. The through hole 38 is provided in the inner portion of the sensor housing portion 37 to penetrate the holder 30 in the third direction Z The temperature sensor module 80 is positioned in a first portion P1 (refer to FIG. 10). In the present embodiment, two of the temperature sensor modules 80 are provided in the first portion P1. The sensor wiring 83 of each of the temperature sensor modules 80 is guided to the Z1 side via the through hole 38. Although not specifically illustrated, the two sensor wirings 83 which are led to the Z1 side are connected to the first circuit substrate 71 and the second circuit substrate 72 via the relay substrate 95 and the relay wiring 90, respectively.

In the head unit 1 according to the present embodiment, the reinforcing plate 50 is provided with a sensor exposure hole 53 which penetrates in the thickness direction at a position mutually facing the temperature sensor 81 of the temperature sensor module 80. The temperature sensor 81 of the temperature sensor module 80 which is housed inside the sensor housing portion 37 of the holder 30 by the sensor exposure hole 53 which is provided in the reinforcing plate 50 directly and mutually faces the fixing plate 40. Therefore, the temperature sensor 81 is capable of directly measuring the temperature on the Z2 side of the fixing plate 40, that is, the temperature in the vicinity of the nozzles 25, and is capable of reducing an error between the actual temperature in the vicinity of the nozzles 25 and the temperature which is measured by the temperature sensor 81 to cause the pressure generating unit to perform driving which is suitable for the actual temperature of the ink to be discharged from the nozzles 25.

Since the temperature sensor 81 is provided in the first portion P1, the temperature of the plurality of drive units 20 may be measured, and thus, it is possible to conserve the number of the temperature sensors 81 in comparison with a case in which the temperature sensors 81 are provided for each of the drive units 20. The temperature sensor 81 is surrounded by the holder 30 and the fixing plate 40, is not exposed to the outside, and is held in the head unit 1. Therefore, even if the ink leaks from the supply member 2 or the supply unit 64 and reaches the ejecting surface 10, for example, when exchanging the head units 1, it is possible to suppress the adherence of the ink to the temperature sensor 81.

The temperature sensor 81 of the present embodiment is in direct contact with the fixing plate 40; however, the invention is not limited to such an aspect, and the temperature sensor 81 may be in contact with the fixing plate 40 via a material which has a higher heat conductivity than air. For example, the temperature sensor 81 may be brought into contact with the fixing plate 40 via a thermally conductive epoxy adhesive, a thermally conductive silicone adhesive, or the like.

Figure 10:
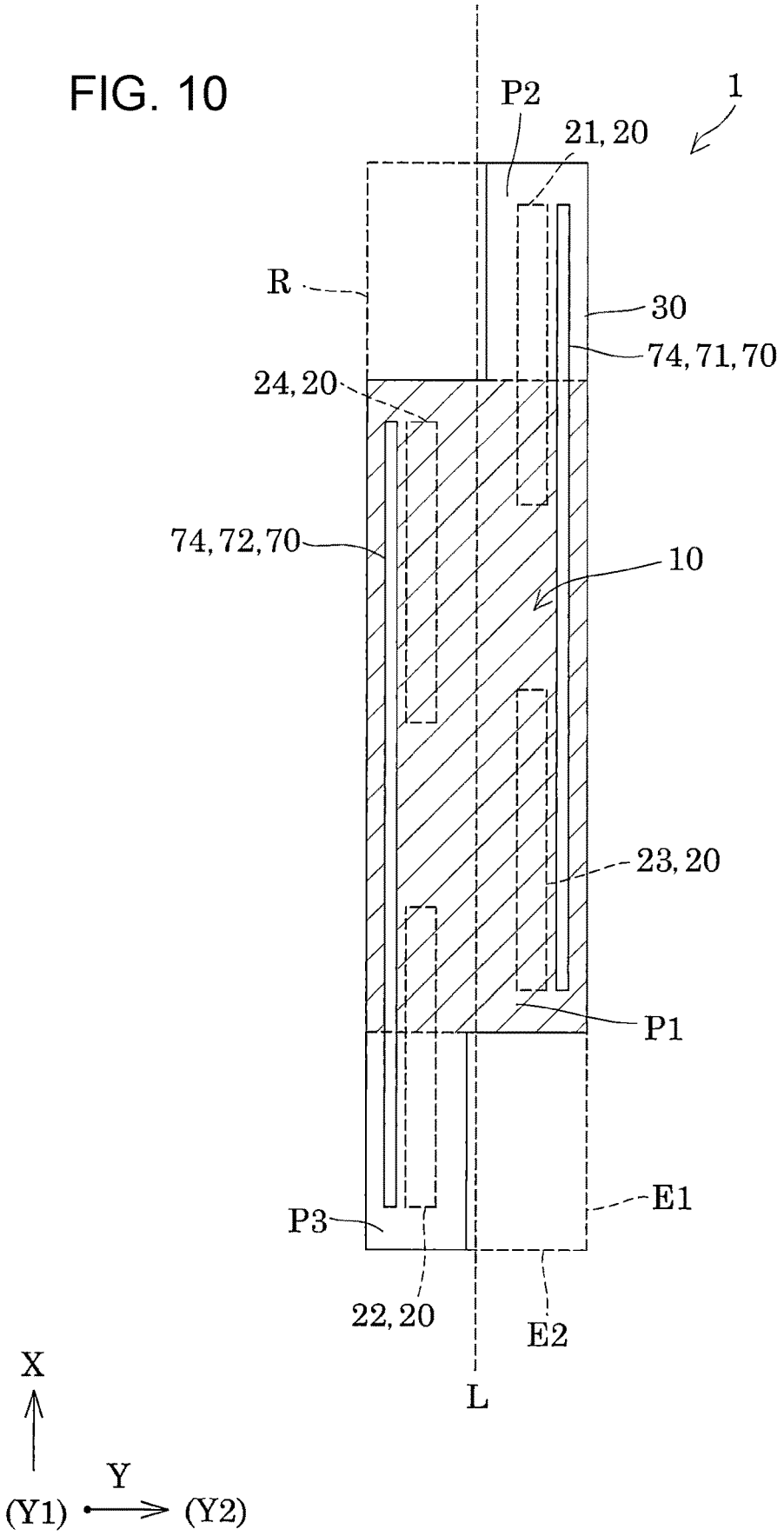
FIG. 10 is a schematic plan view of the head unit.

Here, the disposition of the drive units 20 and the circuit substrate 70 which are disposed in the holder 30 will be described in detail using FIG. 10. FIG. 10 is a schematic plan view of the head unit. In FIG. 10, illustration of the flow path member 60 is omitted, and the drive units 20, the holder 30, and the circuit substrate 70 of the head unit 1 are illustrated.

In the present embodiment, the ejecting surface 10 of the head unit 1 is formed of the nozzle surface 20*a* and the surface the Z2 side of the fixing plate 40 which is fixed to the holder 30.

A rectangle of a minimum area which surrounds the ejecting surface 10 is set to R. In the present embodiment, a long side E1 of the rectangle R overlaps the side along the first direction X of the holder 30, and a short side E2 of the rectangle R overlaps the side along the second direction Y of the holder 30. A center line which is parallel to the long side E1 of the virtual rectangle R is set to L.

The planar shape of the ejecting surface 10 is provided with the first portion P1 (a hatched portion in FIG. 10) through which the center line L passes, and a second portion P2 and a third portion P3 through which the center line L does not pass. The third portion P3 is arranged on the opposite side from the second portion P2 to interpose the first portion P1 In the present embodiment, the first portion P1, the second portion P2, and the third portion P3 are all rectangular.

The first circuit substrate 71 is positioned in the first portion P1 and the second portion P2. In other words, in the plan view of FIG. 10, the first circuit substrate 71 which is disposed along the first direction X is provided from the first portion P1 across to the second portion P2.

The second circuit substrate 72 is positioned in the first portion P1 and the third portion P3. In other words, in the plan view of FIG. 10, the second circuit substrate 72 which is disposed along the first direction X is provided from the first portion P1 across to the third portion P3.

Figure 11:
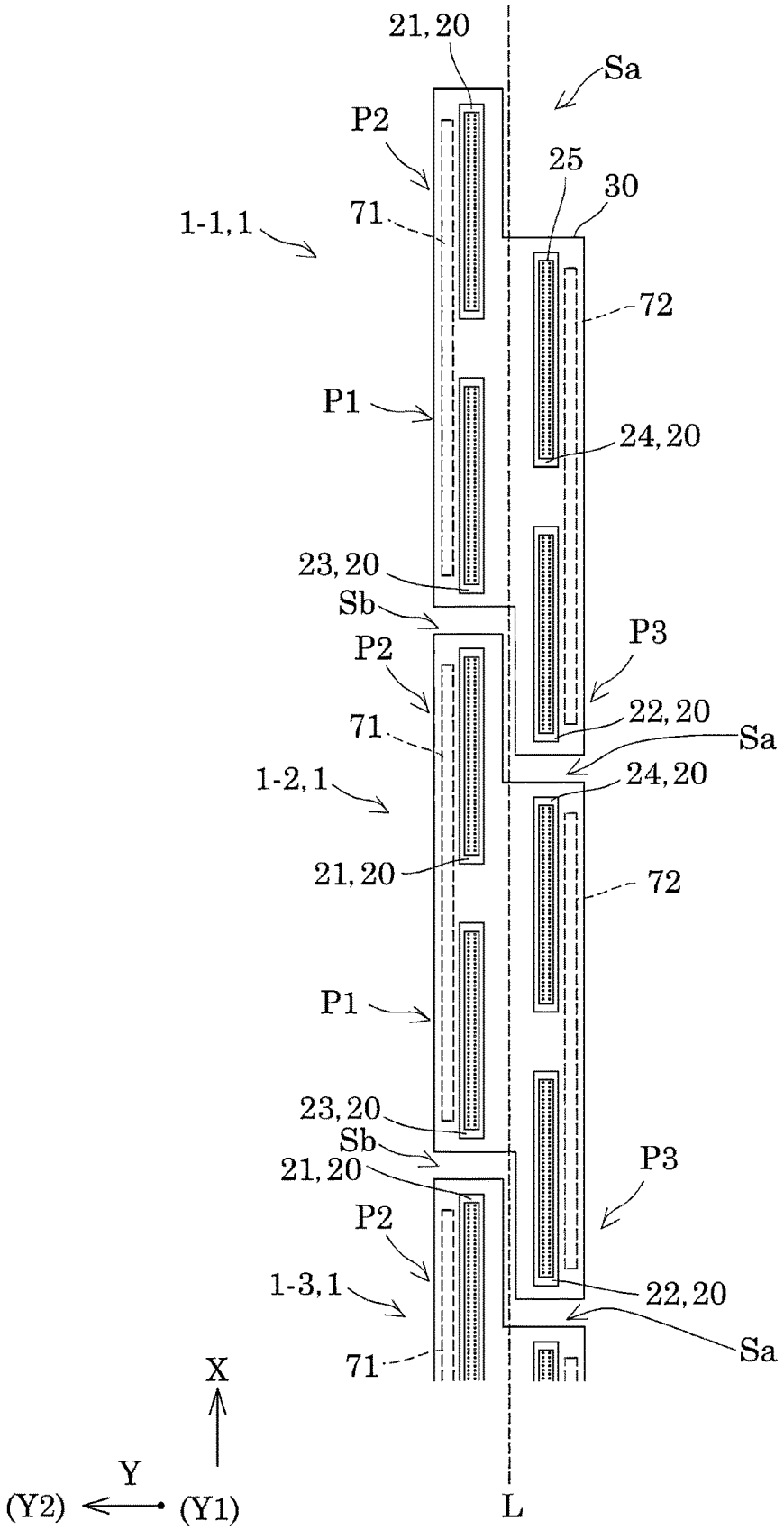
FIG. 11 is a schematic plan view of a plurality of head units which are provided to line up in a first direction.

As illustrated in FIG. 4, a plurality of the head units 1 of this configuration may be disposed linearly. This is described in detail using FIG. 11. FIG. 11 is a schematic plan view of a plurality of head units which are provided to line up in the first direction X.

A plurality of head units, head unit 1-1, head unit 1-2, and head unit 1-3 are provided to line up along the first direction X. When not distinguishing between the head units 1-1, 1-2, and 1-3, these will be referred to as the head unit 1.

Each of the head units 1 is provided with the second portion P2 and the third portion P3 through which the center line L does not pass, the first circuit substrate 71 is positioned in the second portion P2, and the second circuit substrate 72 is positioned in the third portion P3. In other words, the first circuit substrate 71 and the second circuit substrate 72 are not provided on the center line L of the head unit 1.

By adopting this configuration, a space for holding the first circuit substrate 71 and the second circuit substrate 72 becomes unnecessary in the second portion P2 and the third portion P3, and it is possible to narrow the width in the second direction Y. In other words, it is possible to widen the width in the second direction Y of a space Sa on the Y1 side of the second portion P2 and a space Sb on the Y2 side of the third portion P3.

For example, the head unit 1-1 and the head unit 1-2 are provided to line up such that the third portion P3 of the head unit 1-1 is positioned in the space Sa on the Y1 side of the second portion P2 of the head unit 1-2. The nozzle row of the first drive unit 21 of the head unit 1-2 and the nozzle row of the second drive unit 22 of the head unit 1-1 overlap each other in the second direction Y.

In the head unit 1-1 and the head unit 1-2, since the widths of the space Sa and the space Sb are widened as described above, it is possible to aligned the nozzle rows on a straight line along the first direction X. In other words, it is possible to dispose the nozzle rows of the first drive unit 21 and the third drive unit 23 which are disposed on the Y2 side of each of the head units 1 to be aligned on a straight line along the first direction X. The same applies to the nozzle rows of the second drive unit 22 and the fourth drive unit 24 on the Y1 side.

Figure 12:
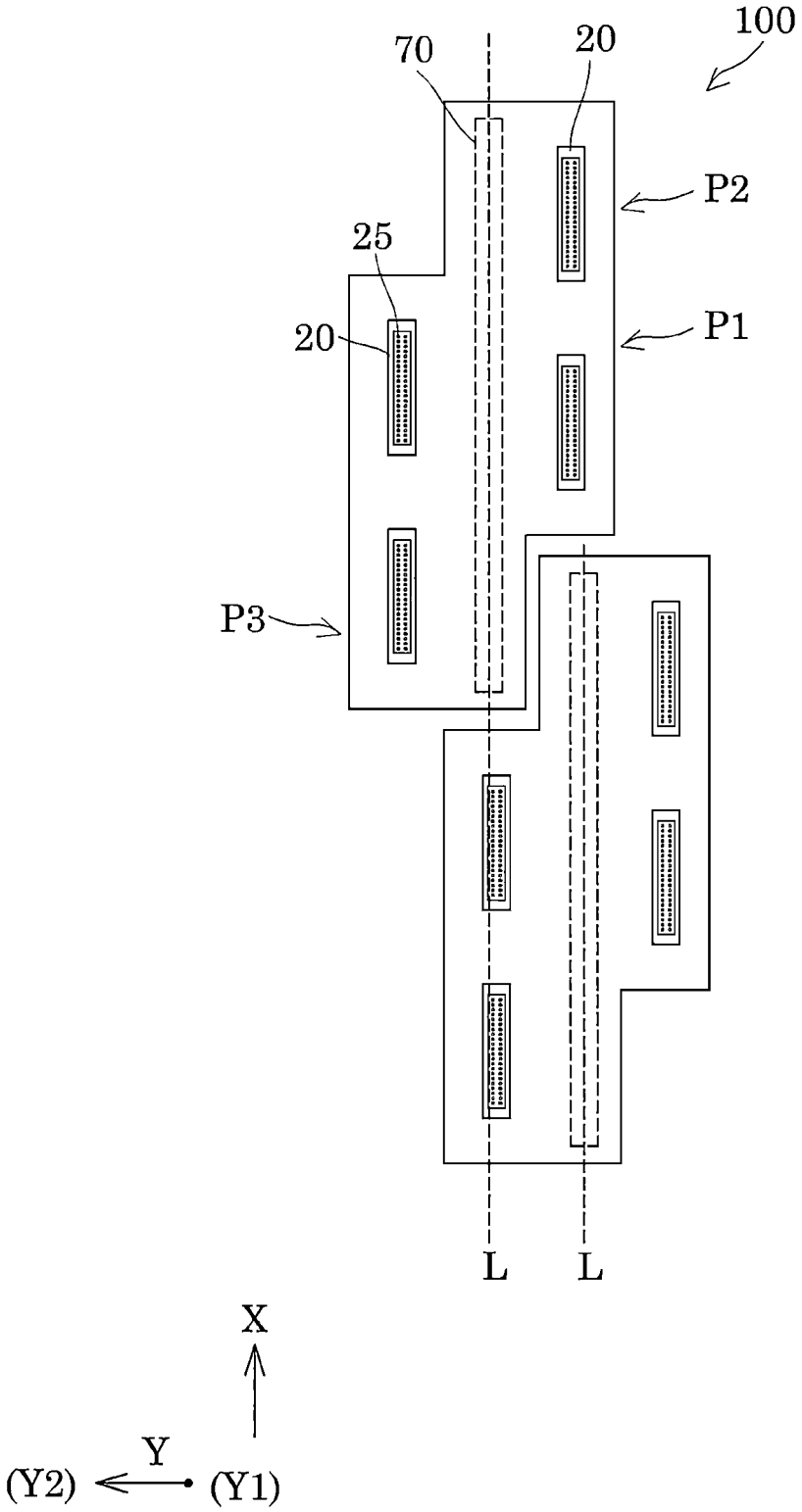
FIG. 12 is a schematic plan view of a head unit according to an example of the related art.

Description will be given of a head unit 100 as an example of the related art using FIG. 12. FIG. 12 is a schematic plan view of the head unit according to the example of the related art.

In the same manner as with the head unit 1, the head unit 100 is provided with the first portion P1, the second portion P2, and the third portion P3. However, the head unit 100 differs from the head unit 1 in that the center line L passes through the second portion P2 and the third portion P3, and the circuit substrate 70 is provided along the center line L.

In the head unit 100, since the circuit substrate 70 is disposed along the center line L, the widths of the second portion P2 and the third portion P3 are wider than those of the head unit 1. In other words, the second portion P2 and the third portion P3 are shaped such that the center line L passes therethrough.

When a plurality of the head units 100 are provided to line up in the first direction X and the nozzle rows are overlapped between the head units 100, the center lines L may not be aligned. Therefore, it is not possible to dispose the nozzle rows of the Y1 side of the head units 100 to be aligned in the first direction X. The same applies to the nozzle rows of the Y2 side.

However, as illustrated in FIG. 11, in the head unit 1 according to the present embodiment, the nozzle rows of the first drive unit 21 and the second drive unit 22 may be caused to overlap the nozzle rows of the second drive unit 22 and the first drive unit 21 of the other head unit 1 in the second direction Y. The nozzle rows of the first drive unit 21 and the third drive unit 23 of the head unit 1 may be aligned with the nozzle rows of the first drive unit 21 and the third drive unit 23 of the other head unit 1 along the first direction X. The nozzle rows of the second drive unit 22 and the fourth drive unit 24 may also be aligned along the first direction X in the same manner.

According to the head unit 1 of the present embodiment, a head unit group which is elongated in the first direction X may be configured using a plurality of the head units 1 having the same configuration.

Since the circuit substrate 70 is disposed on the inner portion the virtual rectangle R, it is possible to reduce the size of the plane which is defined by the first direction X and the second direction Y as compared with the case of using a circuit substrate which has a shape extending from the inner portion to the outside of the rectangle R.

As illustrated in FIG. 10, in the head unit 1 according to the present embodiment, the second portion P2 and the third portion P3 are positioned on opposite sides from each other, interposing the center line L. By adopting this configuration, the first circuit substrate 71 has a shape which is positioned in the first portion P1 and the second portion P2, and the second circuit substrate 72 has a shape which is positioned in the first portion P1 and the third portion P3. In other words, it is possible to utilize common parts in the first circuit substrate 71 and the second circuit substrate 72. Due to the utilization of common parts, even if there are differences in the number of the drive units 20 which are connected to the first circuit substrate 71 and the number of drive units 20 which are connected to the second circuit substrate 72, it is not necessary to provide the first circuit substrate 71 and the second circuit substrate 72 with different shapes corresponding to the numbers.

Figure 13:
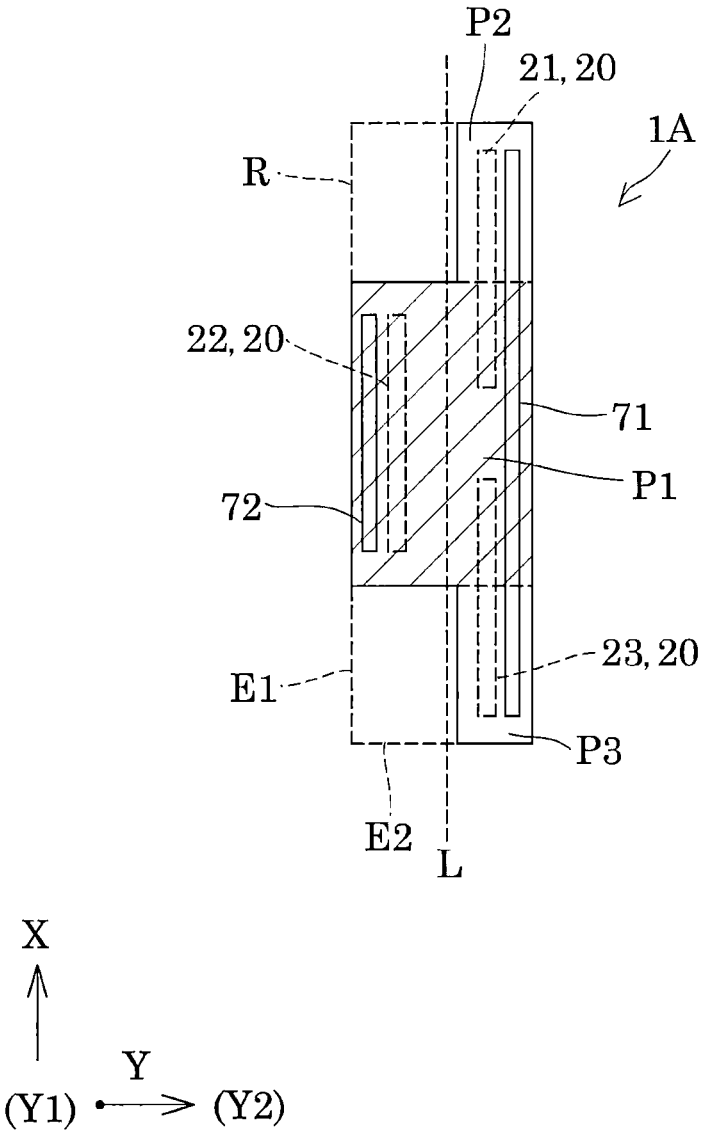
FIG. 13 is a schematic plan view of the head unit.

Hypothetically, in a case in which the second portion P2 and the third portion P3 are positioned on one side of the center line L, the first circuit substrate 71 has a shape which is positioned in the first portion P1 and the second portion P2 (or a shape which is positioned in the first portion P1, the second portion P2, and the third portion P3), and the second circuit substrate 72 has a shape which is positioned only in the first portion P1 (refer to FIG. 13 of the second embodiment). In other words, the first circuit substrate 71 and the second circuit substrate 72 have different shaped and may not utilize common parts.

In the head unit 1 according to the present embodiment, as illustrated in FIG. 10, the first drive unit 21 is connected to the first circuit substrate 71 and is positioned in the first portion P1 and the second portion P2. The second drive unit 22 is connected to the second circuit substrate 72, and is positioned in the first portion P1 and the third portion P3. In other words, the first drive unit 21 is connected to the first circuit substrate 71 which is positioned on the same side with respect to the center line L, and the second drive unit 22 is connected to the second circuit substrate 72 which is positioned on the same side with respect to the center line L. As described above, the head unit 1 is configured such that it is easy to connect the first drive unit 21 and the second drive unit 22 to the first circuit substrate 71 and the second circuit substrate 72, respectively.

In the head unit 1 according to the present embodiment, as illustrated in FIG. 10, the third drive unit 23 is connected to the first circuit substrate 71 and is positioned in the first portion P1. The fourth drive unit 24 is connected to the second circuit substrate 72, and is positioned in the first portion P1. In other words, the third drive unit 23 is connected to the first circuit substrate 71 which is positioned on the same side with respect to the center line L, and the fourth drive unit 24 is connected to the second circuit substrate 72 which is positioned on the same side with respect to the center line L. As described above, the head unit 1 is configured such that it is easy to connect the third drive unit 23 and the fourth drive unit 24 to the first circuit substrate 71 and the second circuit substrate 72, respectively.

In the head unit 1 according to the present embodiment, the wiring which connects the drive units 20 which are connected to the first circuit substrate 71 to the first circuit substrate 71, and the wiring which connects the drive units 20 which are connected to the second circuit substrate 72 to the second circuit substrate 72 are all the same.

Here, the wiring is not only a single wiring which directly connects the drive unit 20 to the circuit substrate 70, but also includes a wiring which connects a plurality of wirings. In the present embodiment, the relay wiring 90, the relay substrate 95 (the wiring which is provided on the relay substrate 95), and the wiring substrate 96 (hereinafter referred to as the wiring group) correspond to the wiring described in the claims.

Therefore, in the present embodiment, the wiring group which connects the first drive unit 21 and the third drive unit 23, which are the drive units 20 which are connected to the first circuit substrate 71, to the first circuit substrate 71 is the same as the wiring group which connects the second drive unit 22 and the fourth drive unit 24, which are the drive units 20 which are connected to the second circuit substrate 72, to the second circuit substrate 72. Specifically, each of the relay wirings 90, the wiring of each of the relay substrates 95, and the wiring substrate 96 are formed with the same shape, length, thickness and material, respectively.

By adopting this configuration, the print signal and the like are supplied to the first drive unit 21 and the third drive unit 23, which are connected to the first circuit substrate 71, and the second drive unit 22 and the fourth drive unit 24, which are connected to the second circuit substrate 72, using the same wiring group. Accordingly, it is possible to reduce the occurrence of variation in the ejection characteristics between the first drive unit 21 and the third drive unit 23, and the second drive unit 22 and the fourth drive unit 24.

Naturally, it is not necessary for the wiring groups to be the same, and the wiring groups may be formed with different shapes, lengths, thicknesses, and materials.

In the head unit 1 according to the present embodiment, the first drive unit 21 and the second drive unit 22 are connected to the first circuit substrate 71 and the second circuit substrate 72, respectively, by a wiring heading from the first drive unit 21 and the second drive unit 22 in the third direction Z which is a direction which is orthogonal to the ejecting surface 10. Here, "wiring" has the same definition as the wiring group which is described above. In the present embodiment, the wiring substrate 96 corresponds to the wiring heading in the third direction Z.

In the second portion P2 and the third portion P3 in which the first drive unit 21 and the second drive unit 22 are positioned, the wiring substrate 96 is drawn out in the third direction Z. Therefore, the second portion P2 and the third portion P3 may be formed with a narrower width in comparison to a configuration in which the wiring substrate 96 is routed in the first direction X or the second direction Y. Accordingly, the nozzle rows of the first drive unit 21 and the second drive unit 22 may be easily caused to overlap each other.

Hypothetically, when the wiring substrate 96 is routed in the first direction X or the second direction Y in the second portion P2 and the third portion P3, there is a corresponding increase in the widths of the second portion P2 and the third portion P3. Therefore, as in the head unit 100 of an example of the related art illustrated in FIG. 12, it becomes difficult to cause the nozzle rows of the drive units 20 to overlap each other. Naturally, the wiring substrate 96 may be routed in the first direction X or the second direction Y.

The head unit 1 according to the present embodiment is provided with the third circuit substrate 73 which is connected to the first circuit substrate 71. The third circuit substrate 73 includes the third connector 77 on the opposite side from the ejecting surface 10 in the third direction Z which is a direction which is orthogonal to the ejecting surface 10.

According to the head unit 1, since the third connector 77 is provided on the opposite side from the ejecting surface 10, it is easy to reconnect the wiring to and from the third connector 77.

In the head unit 1 according to the present embodiment, the third circuit substrate 73 is connected to the second circuit substrate 72, and the first connector 75, the second connector 76, and the third connector 77 (hereinafter also referred to as a connector group) are positioned in the first portion P1. In other words, in the plan view of the head unit 1, the connector groups are positioned in the first portion P1.

Two circuit substrates, the first circuit substrate 71 and the second circuit substrate 72 are provided in the head unit 1; however, the third connector 77 of the third circuit substrate 73 is connected to the external control device at one location. In other words, it is not necessary to connect the first circuit substrate 71 and the second circuit substrate 72 individually to the external control device.

According to the head unit 1, it is possible to reduce the number of the third connectors 77 for connecting to the outside. Since it is possible to reduce the number of the third connectors 77, it is easy to detach and attach the head unit 1 in relation to the supporting body 3. Since the first connector 75 and the second connector 76 are provided in the first portion P1, it is easy to connect the first circuit substrate 71 and the second circuit substrate 72 to the first connection wiring 91 and the second connection wiring 92, respectively.

As illustrated in FIG. 10, in the head unit 1 according to the present embodiment, each of the first circuit substrate 71 and the second circuit substrate 72 includes the substrate 74 which is parallel to a plane including the third direction Z which is orthogonal to the ejecting surface 10 and a direction which is parallel to the long side E1 of the rectangle R.

The flow path member 60 is positioned in the first portion P1 to the third portion P3. The fact that the flow path member 60 is positioned in the first portion P1 to the third portion P3 means that the flow path member 60 is positioned in the first portion P1, the second portion P2, and the third portion P3 in plan view of the head unit 1.

As illustrated in FIG. 8, the flow path member 60 is positioned between the first circuit substrate 71 and the second circuit substrate 72 in the second direction Y which is parallel to the short side E2 of the rectangle R.

In other words, the flow path member 60 is disposed between the first circuit substrate 71 and the second circuit substrate 72 each of which includes the substrate 74 which is parallel to a plane including the first direction X, which corresponds to the direction which is parallel to the long side E1 of the rectangle R, and the third direction Z. By disposing the flow path member 60 in this manner, it is possible to reduce the width of the head unit 1 in the second direction Y as compared with a configuration in which the flow path member 60 is disposed outside of the first circuit substrate 71 and the second circuit substrate 72. The flow path member 60 may not be disposed between the first circuit substrate 71 and the second circuit substrate 72 as described above.

As illustrated in FIGS. 4 and 11, the ink jet recording apparatus I according to the present embodiment is provided with a plurality of the head units 1 in a direction (the first direction X) which is parallel to the long side E1 of the rectangle R. According to the ink jet recording apparatus I, it is possible to elongate the nozzle row in the first direction X by using a plurality of the head units 1 of the same configuration.

As illustrated in FIGS. 5 and 8, in the head unit 1 according to the present embodiment, in the third direction Z, which is a direction which is orthogonal to the ejecting surface 10, the flow path member 60 is disposed between the first connection wiring 91, which connects the first circuit substrate 71 and the third circuit substrate 73, and the ejecting surface 10.

In the head unit 1, since the first connection wiring 91 is routed so as to avoid the flow path member 60, it is easy to connect the first connection wiring 91 to the first circuit substrate 71 and the second circuit substrate 72.

In the head unit 1 according to the present embodiment, as illustrated in FIGS. 5 and 8, a plurality (two in the present embodiment) of the supply units 64 which may be inserted and pulled out in the third direction Z, which is a direction which is orthogonal to the ejecting surface 10, are provided in different positions in the first direction X, which is a direction which is parallel to the long side of the rectangle R. The first connection wiring 91 is disposed between the supply units 64. The fact that the supply unit 64 may be inserted and pulled out in the third direction Z means that a member such as a tube for supplying the ink may be inserted into or pulled out from the supply unit 64 by moving the member in the third direction Z.

In the head unit 1, it is possible to dispose the supply unit 64 and the connector group with high density while preventing interference between the supply unit 64 and the first connection wiring 91. Hypothetically, in a case in which the first connection wiring 91 is not disposed between the supply units 64, for example, in the first direction X, the first connection wiring 91 is routed so as to pass outside of the two supply units 64, and the size of the head unit 1 in the first direction X is increased.

In the head unit 1 of the present embodiment, since the space between the plurality of the supply units 64 is effectively utilized for disposing the first connection wiring 91, it is possible to realize a reduction in the size of the head unit 1.

In the head unit 1 according to the present embodiment, as illustrated in FIG. 8, the cover member 65 houses the first connection wiring 91 in a state of being bent along the flow path member 60.

As described above, since the first connection wiring 91 is not exposed to the outside, the head unit 1 is configured to be easily to detach and attach in relation to the supporting body 3.

Second Embodiment

In the first embodiment, the second portion P2 and the third portion P3 are positioned on opposite sides from each other with respect to the center line L; however, the invention is not limited to this aspect. For example, the second portion P2 and the third portion P3 may be disposed on one side of the center line L.

FIG. 13 is a schematic plan view of a head unit according to the present embodiment. The same reference numerals will be assigned to components which are similar to those of the first embodiment, and redundant description thereof will be omitted.

As illustrated in FIG. 13, in the first direction X, a head unit 1A is provided with the second portion P2 and the third portion P3, interposing the first portion P1 which is hatched. The second portion P2 and the third portion P3 are positioned on one side (the Y2 side) of the center line L.

In the first embodiment, the second circuit substrate 72 is positioned in the first portion P1 and the third portion P3; however, as in the present embodiment, the second circuit substrate 72 is positioned only in the first portion P1. In this manner, the second circuit substrate 72 may be positioned in at least one of the first portion P1 and the third portion P3.

In the first embodiment, the second drive unit 22 is positioned in the first portion P1 and the third portion P3; however, as in the present embodiment, the second drive unit 22 is positioned only in the first portion P1. In this manner, the second drive unit 22 may be positioned in at least one of the first portion P1 and the third portion P3.

Even with the head unit 1A which is configured in this manner, the same effects are achieved as in the head unit 1 of the first embodiment.

Although not specifically illustrated, the external shape of the ejecting surface 10 may be a trapezoid or a parallelogram in plan view. Even with such a shape, it is possible to arrange a plurality of head units side by side overlapping the nozzle rows and provided with the nozzle rows linearly along the first direction X.

Other Embodiment

Each of the embodiments of the invention are described above; however, the basic configuration of the invention is not limited to the above.

In the head unit 1 of the first embodiment, the ejecting surface 10 is formed by the nozzle surface 20*a* and the surface of the Z2 side the fixing plate 40; however, the invention is not limited to this aspect. For example, in a case in which the head unit 1 which is not provided with the fixing plate 40 and the reinforcing plate 50, the ejecting surface 10 may be formed by the nozzle surface 20*a* and the surface of the Z2 side of the holder 30 which holds the drive unit 20.

The head unit 1 of the first embodiment is provided with the temperature sensor 81; however, this is not a mandatory configuration. The head unit 1 of the first embodiment is provided with the third circuit substrate 73; however, this is not a mandatory configuration. The first connector 75, the second connector 76, and the third connector 77 are positioned in the first portion P1 on the third circuit substrate 73; however the first connector 75, the second connector 76, and the third connector 77 may be positioned in the second portion P2 and the third portion P3.

In the embodiments which are described above, the plurality of drive units 20 are disposed in a staggered pattern along the first direction X in the holder 30; however, the invention is not particularly limited thereto. For example, the drive units 20 may be provided to line up in the first direction X or the second direction Y. The drive units 20 may be disposed to line up in both the first direction X and the second direction Y in a so-called matrix.

In the embodiment which is described above, a so-called line recording apparatus in which the head unit 1 is fixed to the apparatus main body 7 and printing is performed only by transporting the recording sheet S is exemplified as the ink jet recording apparatus I; however, the embodiment is not particularly limited thereto, and for example, it is possible to apply the invention to a so-called serial recording apparatus in which the head unit 1 is mounted on a supporting body such as a carriage that moves in the first direction X which intersects the second direction Y, which is the transport direction of the recording sheet S, and printing is performed while moving the head unit 1 in the first direction X together with the supporting body.

In the embodiments which are described above, the ink jet recording head unit is given as an example of the liquid ejecting head unit, and an ink jet recording apparatus is given as an example of the liquid ejecting apparatus; however, the invention is widely targeted at liquid ejecting head units and liquid ejecting apparatuses in general, and naturally, it is possible to apply the invention to a liquid ejecting head unit or a liquid ejecting apparatus which ejects a liquid other than the ink. Examples of other liquid ejecting heads include a variety of recording head units which are used in an image recording apparatus such as a printer, color material ejecting head units which are used in the manufacture of color filters of liquid crystal displays and the like, electrode material ejecting head units which are used to form electrodes such as organic EL displays, field emission displays (FED) and the like, and biological organic substance ejecting head units which are used in the manufacture of biochips. It is possible to apply the other liquid ejecting heads to a liquid ejecting apparatus which is provided with the liquid ejecting head unit.

What is claimed is:

1. A liquid ejecting head unit comprising:

a plurality of nozzles for ejecting a liquid;

a first circuit substrate and a second circuit substrate for ejecting the liquid from the nozzles;

a first drive unit, a second drive unit, a third drive unit, and a fourth drive unit, each of which has a part of the plurality of nozzles and is disposed between the first circuit substrate and the second circuit substrate in a first direction;

a housing configured to house the first drive unit, the second drive unit, the third drive unit, and the fourth drive unit; and a fixing plate configured to seal the first drive unit, the second drive unit, and the third drive unit, and the fourth drive unit in the housing;

wherein the plurality of nozzles are positioned at either of a first portion, a second portion and a third portion, each of the first portion, the second portion, and the third portion having at least one of nozzles out of the plurality of nozzles, wherein the first portion has a first width in the first direction, wherein the second portion has a second width in the first direction, the second width is smaller than the first width, wherein the third portion has a third width in the first direction, the third width is smaller than the first width, wherein the first portion is positioned between the second portion and the third portion in a second direction that is orthogonal to the first direction, wherein the first circuit substrate is positioned in the first portion and the second portion in the second direction, wherein the second circuit substrate is positioned in at least one of the first portion and the third portion in the second direction, wherein the first circuit substrate and the second circuit substrate are positioned on opposite sides of the liquid ejecting head unit in the first direction and opposite to a side of the housing having the fixing plate, wherein the first drive unit is connected to the first circuit substrate, wherein a full length of the first drive unit is positioned across a boundary between the first portion and the second portion in the second direction, wherein the second drive unit is connected to the second circuit substrate, wherein a full length of the second drive unit is positioned across a boundary between the first portion and the third portion in the second direction, wherein the third drive unit is connected to the first circuit substrate, wherein a full length of the third drive unit is positioned in the first portion in the second direction, wherein the fourth drive unit is connected to the second circuit substrate, and wherein a full length of the fourth drive unit is positioned in the first portion in the second direction.

2. The liquid ejecting head unit according to claim 1, wherein the second width is equal to the third width.

3. The liquid ejecting head unit according to claim 1, wherein the second width is smaller than a half of the first width, and wherein the third width is smaller than a half of the first width.

4. The liquid ejecting head unit according to claim 1, wherein a position of the second portion in the first direction is different from a position of the third portion in the first direction.

5. The liquid ejecting head unit according to claim 1, wherein one edge of the second portion in the first direction is on line with one edge of the first portion in the first direction, and wherein one edge of the third portion in the first direction is on line with the other edge of the first portion in the first direction.

6. The liquid ejecting head unit according to claim 1, wherein the second portion adjoins to one edge of the first portion in the second direction, and wherein the third portion adjoins to the other edge of the first portion in the second direction.

7. The liquid ejecting head unit according to claim 1, wherein the second circuit substrate is positioned in the first portion and the third portion in the second direction.

8. A liquid ejecting apparatus comprising:

the liquid ejecting head unit according to claim 1, and a controller configured to control operation of the liquid ejecting head unit.

9. The liquid ejecting head unit according to claim 1, wherein position of the first drive unit in the first direction is same as position of the third drive unit in the first direction, and wherein position of the second drive unit in the first direction is same as position of the fourth drive unit in the first direction.

10. The liquid ejecting head unit according to claim 1, wherein the third drive unit is positioned between the second drive unit and the fourth drive unit in the second direction, and wherein the fourth drive unit is positioned between the first drive unit and the third drive unit in the second direction.

11. The liquid ejecting head unit according to claim 1, wherein the first circuit substrate is connected to both the first drive unit and the third drive unit, but not connected to the second drive unit or the fourth drive unit, and wherein the second circuit substrate is connected to both the second drive unit and the fourth drive unit, but not connected to the first drive unit or the third drive unit.

12. The liquid ejecting head unit according to claim 1, the liquid ejecting head unit further comprising:

a fixing plate configured to hold the first drive unit, the second drive unit, the third drive unit, and the fourth drive unit in place; and a temperature sensor attached to the fixing plate configured to detect a temperature in an area next to the nozzles.

13. The liquid ejecting head unit according to claim 1, wherein:

the liquid ejecting head includes a first and second relay wiring and a connection wiring for each of the first circuit substrate and the second circuit substrate, the first relay wiring and the second relay wiring of each of the first circuit substrate and the second circuit substrate are disposed on opposite sides of the corresponding circuit substrate, the first relay wiring and the second relay wiring of the first circuit substrate is connected to the first drive unit and the third drive unit respectively, the first relay wiring and the second relay wiring of the second circuit substrate is connected to the second drive unit and the fourth drive unit respectively, and the connection wiring of each of the first circuit substrate and the second circuit substrate is disposed at an end of the corresponding circuit substrate that is further away from the nozzles in a third direction that intersects both the first direction and the second direction, the connection wiring of each of the first circuit substrate and the second circuit substrate is configured to supply a signal and power from a control unit, circuit substrate is configured to supply a signal and power from a control unit.

* * * * *